US005562468A

United States Patent [19]

Sakai et al.

[11] Patent Number: 5,562,468

[45] Date of Patent: Oct. 8, 1996

[54] JOINT CONNECTOR

[75] Inventors: Hitoshi Sakai; Hitoshi Saito; Hiroshi Yamamoto, all of Shizuoka, Japan

[73] Assignee: Yazaki Corporation, Tokyo, Japan

[21] Appl. No.: 282,461

[22] Filed: Aug. 1, 1994

[30] Foreign Application Priority Data

Jul. 30, 1993 [JP] Japan ..... 5-206814

[51] Int. Cl.[6] ..... H01R 31/08

[52] U.S. Cl. ..... 439/189; 439/923

[58] Field of Search ..... 439/189, 507, 439/509, 510, 511, 923

[56] References Cited

U.S. PATENT DOCUMENTS

| | | | |
|---|---|---|---|
| 4,918,513 | 4/1990 | Kurose et al. | 439/923 |
| 4,934,944 | 6/1990 | Kozel et al. | 439/923 |
| 5,215,472 | 6/1993 | Del Prete et al. | 439/923 |
| 5,281,165 | 1/1994 | McCleerey et al. | 439/923 |

FOREIGN PATENT DOCUMENTS 1-73785 5/1989 Japan .

*Primary Examiner*—Gary F. Paumen

*Attorney, Agent, or Firm*—Sughrue, Mion, Zinn, Macpeak & Seas

[57] ABSTRACT

A joint connector has a notch for exposing an outer peripheral surface of a bus bar-containing holder to the exterior when the holder is fitted in a holder receiving chamber is formed in a peripheral wall of the holder receiving chamber. Steps are formed at the outer peripheral surface of the bus bar containing holder, each of the steps being located at the notch when the bus bar-containing holder is fitted in the holder receiving chamber, thereby enabling the lifting of the bus bar-containing holder. A step is provided at the notch, so that the notch has a stair-like configuration. A plurality of notches and a plurality of pairs of steps are provided at the peripheral wall of the holder receiving chamber and the outer peripheral surface of the bus bar-containing holder, respectively.

2 Claims, 4 Drawing Sheets

JOINT CONNECTOR

BACKGROUND OF THE INVENTION

1. Field of Invention

This invention relates to a joint connector in which a bus bar-containing holder having projected tab terminals is fitted in a housing to interconnect terminals provided in this housing, and more particularly to a construction in which the bus bar-containing holder, fitted in the housing, can be easily removed from the housing.

2. Related Art

A joint connector is used, for example, for connecting a main cable to a plurality of secondary branching wires.

One example of such a joint connector is disclosed in Japanese Utility Model Unexamined Publication No. 1-73785 in which a bus bar-containing holder is received in a housing in such a manner that the former is not projected from the latter. The construction disclosed in this publication will now be described with reference to FIGS. 8 and 9. FIG. 8 is a perspective view of the conventional bus bar-containing holder, and FIG. 9 is a perspective view of the conventional housing.

As shown in FIG. 8, a bus bar-containing holder (holder) 1 has a bur bar 5 mounted thereon, the bus bar 5 having a plurality of tab terminals 3. The tab terminals 3 are integrally interconnected by a base portion (not shown) of the bus bar 5. Elastic arms 7 are formed on opposite ends of the holder 1, respectively, and each of the elastic arms 7 has a projection 9 formed on a side surface thereof.

As shown in FIG. 9, a housing 11 has holder receiving chambers 13, and the holder receiving chamber 13 has a plurality of terminal receiving chambers (not shown) each having a female terminal mounted therein. Holes 15 are formed respectively through opposite end walls of the holder receiving chamber 13, and extend to the exterior. The projections 9 on the holder 1 are engageable in the holes 15, respectively.

In the joint connector of this construction, when the holder 1 is inserted into the holder receiving chamber 13 in the housing 11, the elastic arms 7 are flexed to be received in the holder receiving chamber 13, and the projections 9 are resiliently fitted and engaged in the holes 15, respectively. At the same time, the tab terminals 3 of the holder 1 are fitted respectively in the female terminals (not shown) provided in the holder receiving chamber 13, thereby electrically connecting the female terminals together, thus completing the connection of the holder 1 to the housing 11.

In the connection-completed condition of the joint connector, the holder 1 is embedded in the housing 11 such that any portion is not projected from the housing. Therefore, the connected portions are in a compact condition, and also the withdrawal of the holder, which would occur upon contact of any projected portion with a foreign matter, is prevented.

FIG. 10 is a perspective view of the above joint connector in a fitted condition.

The joint connector in this connected condition has no projected portion, and therefore a withdrawing tool 17 having a pointed tip is used for releasing the fitting of the holder 1 in the housing 11.

When using the withdrawing tool 17, its tip is inserted into a gap between the inner periphery of the holder receiving chamber 13 and the holder 1, and the tool is forcibly turned back and forth and right and left to move the holder 1 relative to the housing 11, thereby gradually lifting the holder 1 to release the fitting.

However, when the fitting condition of the joint connector is to be released, the withdrawing tool 17 is inserted into the gap between the inner periphery of the holder receiving chamber 13 and the holder 1, and is forcibly turned. In this case, the force is divided into two directions x and y (see FIG. 11), and therefore the releasing efficiency is poor, and where the fitting force is high in the joint connector, there is a possibility that the holder 1 and the housing may be deformed. Further, when the withdrawing tool 17 is forcibly turned, a reaction force acts in a direction (the direction of acting of the force x) of the thickness of the inner wall (having a smaller strength) of the holder receiving chamber, and therefore the housing 11 is more liable to deformation.

SUMMARY OF THE INVENTION

The present invention has been made in view of the above problems, and an object of the invention is to provide a joint connector in which the direction of forcible turning of a tool is limited to one direction, and the fitting can be released easily, thus enhancing the releasing operation.

The above object has been achieved by a joint connector of the present invention wherein a holder receiving chamber is formed in a housing, and a bus bar-containing holder is fitted in the holder receiving chamber to achieve a connection; characterized in that a notch for exposing an outer peripheral surface of the bus bar-containing holder to the exterior when the holder is fitted in the holder receiving chamber is formed in a peripheral wall of the holder receiving chamber; and a step is formed at the outer peripheral surface of the bus bar-containing holder, the step being located at the notch when the bus bar-containing holder is fitted in the holder receiving chamber, thereby enabling the lifting of the bus bar-containing holder.

Preferably, a step is provided at the notch, so that the notch has a stair-like configuration.

A plurality of the notches and a plurality of pairs of the steps may be provided at the peripheral wall of the holder receiving chamber and the outer peripheral surface of the bus bar-containing holder, respectively, each of the notches being sequentially brought into registry with associated ones of the steps as the amount of lifting of the bus bar-containing holder increases.

The step, located at the notch when the bus bar-containing holder is fitted in the housing, is lifted by a withdrawing tool through the notch, and the step is lifted by leverage, and therefore a large lifting force is produced with a small force, and the thus produced lifting force is concentrated in one direction, and the forcibly-opening force is efficiently used for releasing the fitting.

Where the notch has a stair-like configuration, or where a plurality of notches and a plurality of steps, which are sequentially brought into registry with each other as the amount of lifting increases, are provided, the steps are positioned at their respective optimum locations with respect to the corresponding notch during the lifting of the bus bar-containing holder, and the continuous lifting operation can be effected until the fitting is released.

DETAILED DESCRIPTION OF THE PREFERRED EMBODIMENTS

One preferred embodiment of a joint connector of the present invention will now be described in detail with reference to the drawings.

Figure 1:
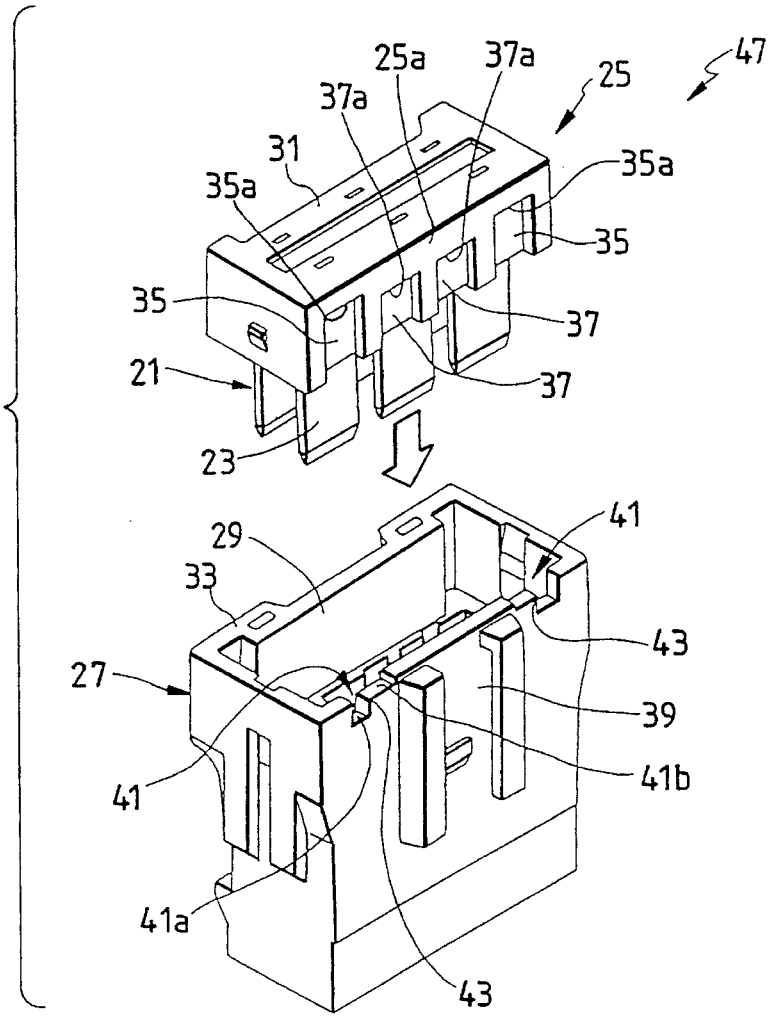
FIG. 1 is a perspective view of a joint connector of the present invention before the fitting.
Figure 2:
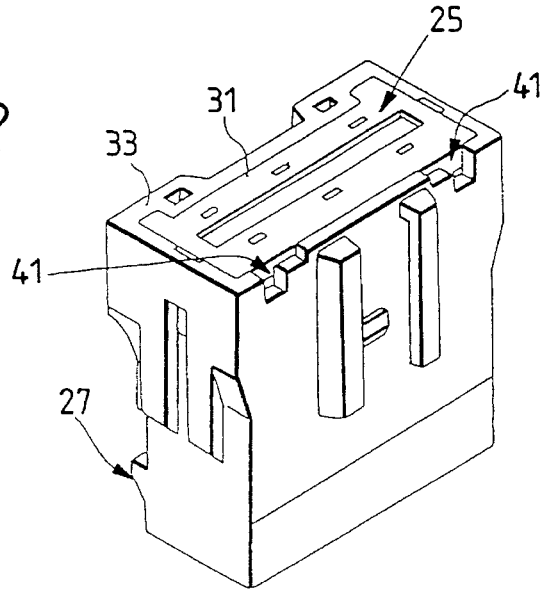
FIG. 2 is a perspective view of the joint connector of the present invention in a fitted condition.
Figure 3:
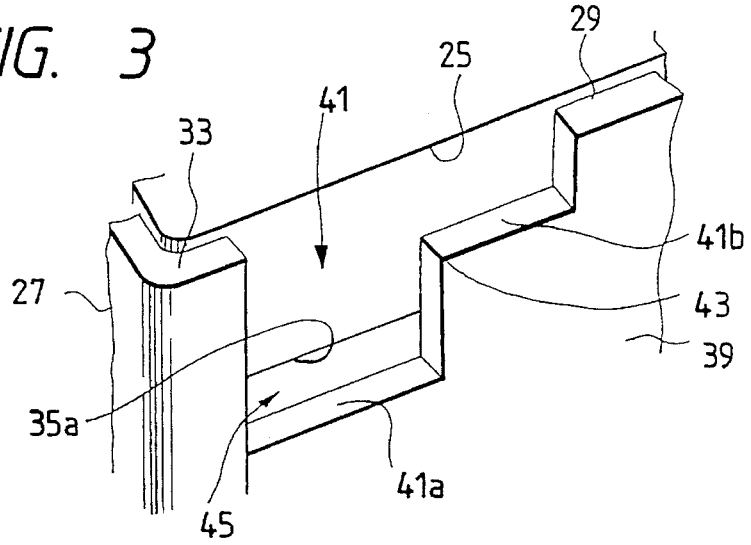
FIG. 3 is an enlarged view of a notch.

FIG. 1 is a perspective view of the joint connector of the invention before the fitting, FIG. 2 is a perspective view of the joint connector of the invention in a fitted condition, and FIG. 3 is an enlarged view showing a notch.

As shown in FIG. 1, a plurality of tab terminals 23 are formed on a bus bar 21, and the opposed ones or the juxtaposed ones of the tab terminals 23 are integrally interconnected by a base portion (not shown). The bus bar 21 is provided on an insulative synthetic resin material by press-fitting or molding to form a bus bar-containing holder (holder) 25.

A housing 27 has a holder receiving chamber 29, and an inner periphery of the holder receiving chamber 29 is formed into such a configuration that it can receive the holder 25 therein. As shown in FIG. 2, when the holder 25 is received in the holder receiving chamber 29, that surface (hereinafter referred to as "holder rear surface") of the holder 25 facing away from the projected tab terminals 23 lies substantially flush with an open end surface 33 of the holder receiving chamber 29.

As shown in FIG. 1, a pair of first recesses 35 of a rectangular shape are formed in an outer peripheral surface 25*a* of the holder 25 which can face the inner peripheral surface of the holder receiving chamber 29, and a step 35*a* is formed at that end of the first recess 25 close to the holder rear surface 31. A pair of second recesses 37 are formed between the first recesses 35, and a step 37*a* is formed at that end of the second recess 37 close to the holder rear surface 31. Here, the first recesses 35 are disposed closer to the holder rear surface 31 than the second recesses 37 are. Therefore, the steps 35*a* are closer to the holder rear surface 31 than the steps 37*a* are.

A pair of notches 41 are formed in a peripheral wall 39 of the holder receiving chamber 29 by cutting its open end surface 33. When the holder 25 is to be inserted into the holder receiving chamber 29, the notches 41 are brought into registry with the first recesses 35, respectively. The first recess 35 is generally equal in width to the notch 41. Namely, when the holder 25 is being inserted into the holder receiving chamber 29, the first recess 35 and the associated notch 41 are moved relative to each other in overlapping relation to each other.

As shown in FIG. 3, a step 43 is formed at the notched portion 41, and the bottom of the notch 41 is divided by the step 43 into a deeper portion 41*a* and a shallower portion 41*b*. Namely, the notched portion 41 is of a stair-like shape.

Although the above notch 41 is formed by cutting the open end surface 33, the notch 41 may be a slit-like hole having a closed inner periphery, with the open end surface 33 not cut.

A predetermined positional relation is provided between each notch 41 and the associated first recess 35. More specifically, when the holder 25 is inserted into the holder receiving chamber 29, with the holder rear surface 31 disposed substantially flush with the open end surface 33, a gap 45 (see FIG. 3) for allowing a tip of a withdrawing tool 17 (see FIG. 4) to be inserted thereinto is formed between the step 35*a* of the first recess 35 and the deeper portion 41*a* of the notch 41. Therefore, the tip of the withdrawing tool 17 is inserted into the gap 45, and the step 35*a* is lifted by leverage, using the deeper portion 41*a* as a fulcrum. After the step 35*a* is similarly lifted, using the shallower portion 41*b*, another gap is formed between the step 37*a* of each second recess 37 and the open end surface 33. Thus, as the amount of lifting of the holder 25 increases, each step 35*a* and each step 37*a* is sequentially brought into registry with the notch 41 and the open end surface 33, respectively.

The holder 25, the housing 27, the first recesses 35, the second recesses 37 and the notches 41 are main components or portions constituting the joint connector 47.

The procedure of releasing the fitting condition of the joint connector 47 of this construction will now be described with reference to FIGS. 4 to 6.

Figure 4:
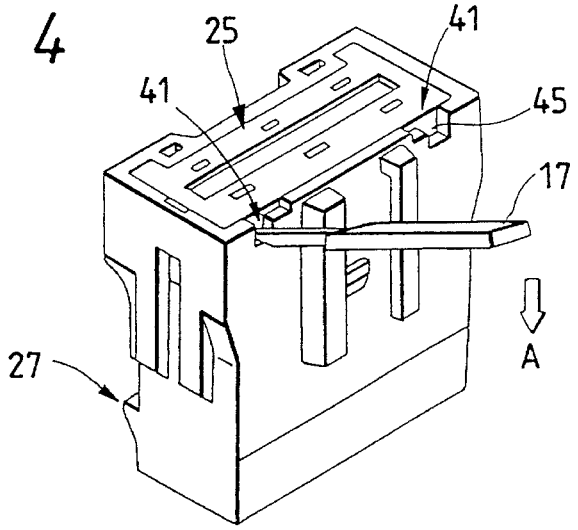
FIG. 4 is a perspective view showing a lifting operation at a deeper portion of the notch.
Figure 5:
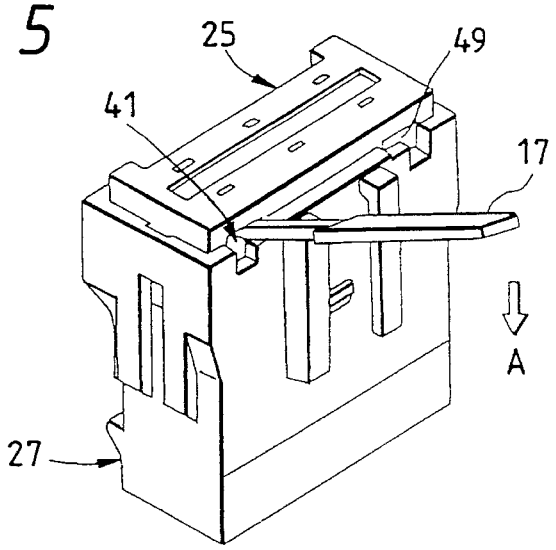
FIG. 5 is a perspective view showing a lifting operation at a shallower portion of the notch.
Figure 6:
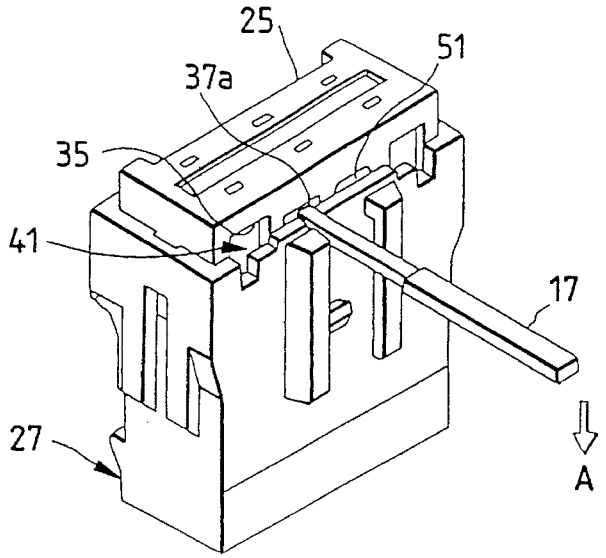
FIG. 6 is a perspective view showing a lifting operation at a second recess and an open end surface.

FIG. 4 is a perspective view showing the lifting condition at the deeper portion of the notch, FIG. 5 is a perspective view showing the lifting condition at the shallower portion, and FIG. 6 is a perspective view showing the lifting condition at the second recess and the open end surface.

For releasing the fitting condition of the joint connector 47, the tip of the withdrawing tool 17 is first inserted into the gap 45 formed between the step 35*a* and the deeper portion 41*a* when the holder 25 is fitted in the housing 27, as shown in FIG. 4, and the withdrawing tool 17 is moved by leverage in a direction A to lift the step 35*a*.

The holder 25 is thus lifted until a gap 49 (see FIG. 5) is formed between the step 35*a* and the shallower portion 41*b*, and then the tip of the withdrawing tool 17 is inserted into the gap 49, and the withdrawing tool 17 is similarly moved by leverage in a direction A by leverage to lift the step 35*a*.

The holder 25 is further lifted until another gap 51 (see FIG. 6) is formed between the step 37*a* of the second recess 37 and the open end surface 33, and then the tip of the withdrawing tool 17 is inserted into this gap 51, and the withdrawing tool 17 is similarly moved by leverage in a direction A to lift the step 37*a*, and finally the fitting of the holder 25 in the housing 27 is released.

In the above joint connector 47, since the holder 25 is lifted in one direction by leverage, a large lifting force is produced with a small force, and also the thus produced lifting force is efficiently concentrated for releasing the fitting. And besides this operation is repeatedly carried out utilizing the gaps 45, 49 and 51 formed sequentially during the lifting of the holder 25, and therefore a good operation efficiency is always obtained, and the fitting can be released positively.

Figure 7:
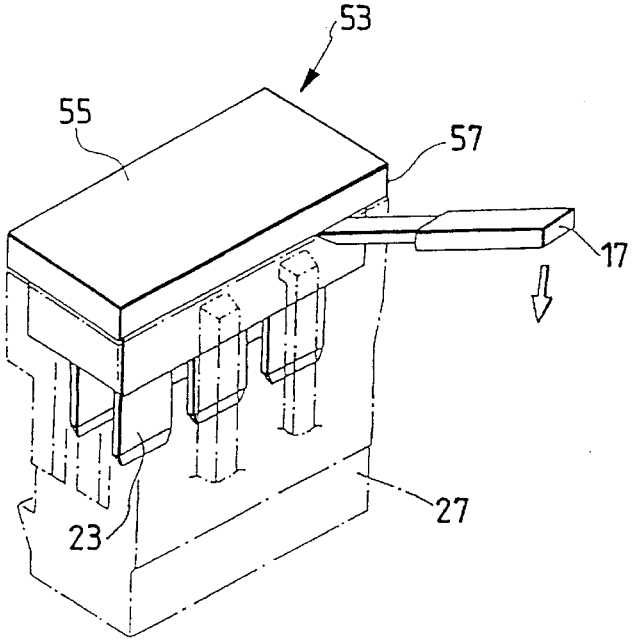
FIG. 7 is a perspective view of another preferred embodiment of a holder.
Figure 8:
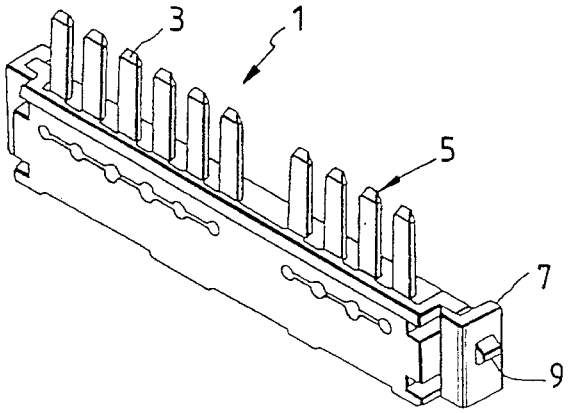
FIG. 8 PRIOR ART
FIG. 8 is a perspective view of a conventional bus bar-containing holder.
Figure 9:
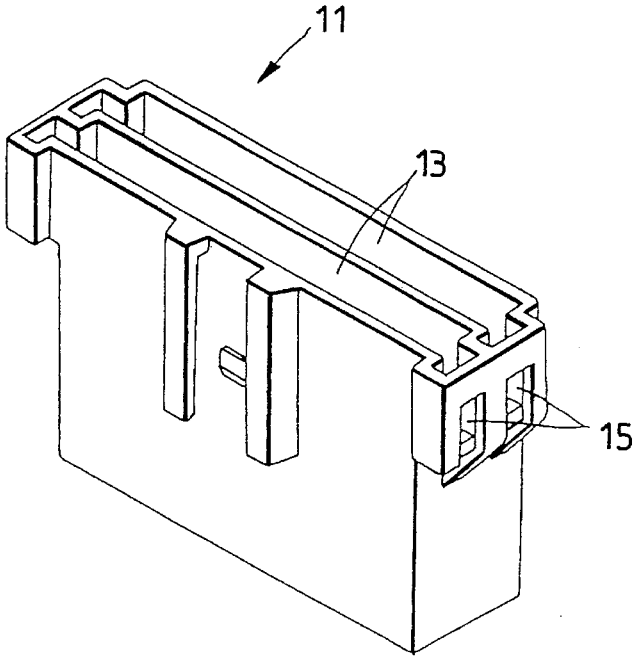
FIG. 9 PRIOR ART
FIG. 9 is a perspective view of a conventional housing.
Figure 10:
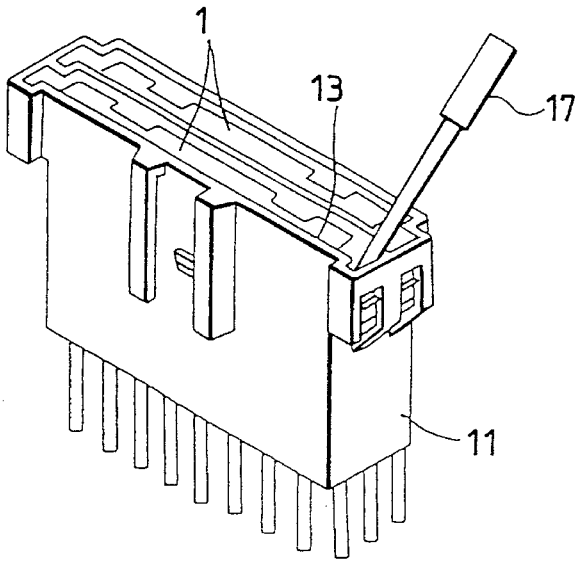
FIG. 10 PRIOR ART
FIG. 10 is a perspective view showing a fitted condition of a joint connector.
Figure 11:
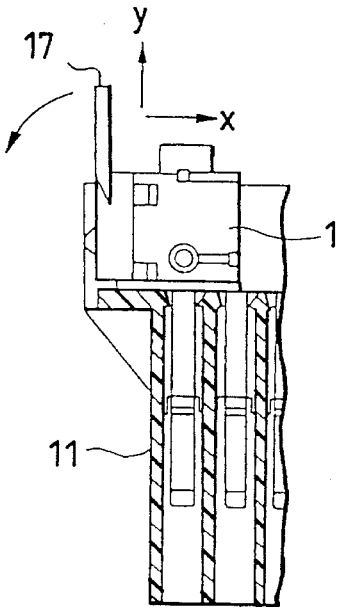
FIG. 11 PRIOR ART
FIG. 11 is a cross-sectional view showing a fitting-releasing operation.

FIG. 7 is a perspective view showing another embodiment of a holder.

In this embodiment, a flange 57 is formed on the holder 53 immediately adjacent to a holder rear surface 55, and an outer periphery of the flange 57 is substantially equal in shape to that of a housing 27. Therefore, that side of the holder 53 having tab terminals 23 is inserted into a holder receiving chamber 29, the flange 57 is abutted against an open end surface 33 of the housing 27, so that the outer periphery of the housing 27 is continuous with the outer periphery of the flange 57.

For releasing the fitting of the holder 53, the tip of the withdrawing tool 17 is forced in between the open end surface 33 of the housing 27 and the flange 57, and the flange 57 is lifted by leverage.

Thus, the holder 53 is lifted, and a large lifting force is produced with a small force, and is efficiently concentrated for releasing the fitting, and therefore the fitting can be released with a good operating efficiency.

In this embodiment, the structure by which the lifting force is concentrated for efficiently releasing the fitting can be achieved with the simple construction.

In the above joint connector 47, although one step 43 is formed on the notched portion 41 to divide the bottom of the notched portion 41 into the deeper portion 41*a* and the shallower portion 41*b*, the step 43 may not be formed on the notched portion 41. Alternatively, in contrast with such an arrangement, a plurality of steps 43 may be provided.

In the above joint connector 47, although one step 35*a* and one step 37*a* are provided respectively at the first and second recesses 35 and 37 while one step 43 is provided at the notch 41, a plurality of steps may be formed in a stair-like manner at each of the first and second recesses 35 and 37 in the direction of the width thereof while the step 43 may not be provided at the notch 41. In this case, it is preferred that the width of the notch 41 should be equal to the widths of the recesses so that the notch 41 can be brought into registry with all of the stair-like steps.

As described above in detail, in the joint connector of the present invention, the step for enabling the lifting by leverage when the bus bar-containing holder is fitted in the housing is provided at the notch, and therefore the large lifting force is produced with a small force, and also the thus produced lifting force is concentrated in one direction, and the forcibly-releasing force can be used efficiency for releasing the fitting. As a result, the efficiency of releasing the fitting of the joint connector can be markedly enhanced.

Where the step is provided at the notch, or where a pair of notches and a plurality of pairs of steps, which are sequentially brought into registry with each other as the amount of lifting increases, are provided, the steps are positioned at their respective optimum locations with respect to the corresponding notch during the lifting of the bus bar-containing holder, and the continuous lifting operation can be effected until the fitting is released, and therefore the fitting can be released easily and positively.

What is claimed is:

1. A joint connector comprising:

a housing having a holder receiving chamber; and a holder having a bus bar, the holder being insertable into said holder receiving chamber in an insertion direction to achieve a connection of the bus bar; and fitting releasing means for enabling the lifting of the holder, the fitting releasing means including:

a plurality of notches provided in a side wall of said housing, said notches being adjacent one another in a lateral direction of said housing with one of said notches being shallower in the insertion direction than the adjacent notch, and a recess provided in an exterior surface of said holder so as to define an upper stepped surface, said recess being positioned such that said upper stepped surface at least partially overlaps each of said adjacent notches in said lateral direction, wherein said holder is removable by inserting an insertion tool in said adjacent notch to engage said upper stepped surface and wedging said holder in a direction opposite said insertion direction and, thereafter, inserting said insertion tool in said one notch to engage said upper stepped surface of said holder and wedging said holder further in said opposite direction.

2. The joint connector of claim 1, wherein said fitting releasing means further includes another recess provided in said exterior surface.

* * * * *